United States Patent [19]

Espedal

[11] Patent Number: 4,527,997

[45] Date of Patent: Jul. 9, 1985

[54] COAL GASIFICATION APPARATUS

[75] Inventor: Michael L. Espedal, Houston, Tex.

[73] Assignee: Texaco Inc., White Plains, N.Y.

[21] Appl. No.: 407,396

[22] Filed: Aug. 12, 1982

[51] Int. Cl.[3] ..... C10J 3/50

[52] U.S. Cl. ..... 48/86 R; 48/63; 48/77; 48/DIG. 7; 239/112; 239/132.5

[58] Field of Search ..... 239/112, 132.5; 48/86 R, DIG. 7, 62 R, 63, 77

[56] References Cited

U.S. PATENT DOCUMENTS

| | | | |
|---|---|---|---|
| 1,045,457 | 11/1912 | Thomas | 239/112 |
| 2,655,986 | 10/1953 | Pennington | 239/112 |
| 4,206,713 | 6/1980 | Ryason | 48/86 R |
| 4,218,222 | 8/1980 | Nolan, Jr. et al. | 48/86 R X |
| 4,364,744 | 12/1982 | Crouch et al. | 48/86 R |

*Primary Examiner*—Peter Kratz

*Assistant Examiner*—Joye L. Woodard

*Attorney, Agent, or Firm*—Robert A. Kulason; Robert B. Burns

[57] ABSTRACT

Coal gasification apparatus wherein a combustible mixture is formed and burned, comprising a combustion supporting gas such as oxygen, and a coal slurry. The hot products of combustion which issue from the burner, are directed into the reaction chamber of a synthesis gas generator. To avoid deposition of slag and ash particles along the hot, exposed face of the burner, a dynamic fluid blanket or barrier is directed transversely of the burner face. The reaction chamber includes an elongated port in which the burner is registered. To shield the burner, a manifold depends from the reaction chamber wall adjacent to the burner face and projects a stream of coolant fluid transversely of the face.

10 Claims, 3 Drawing Figures

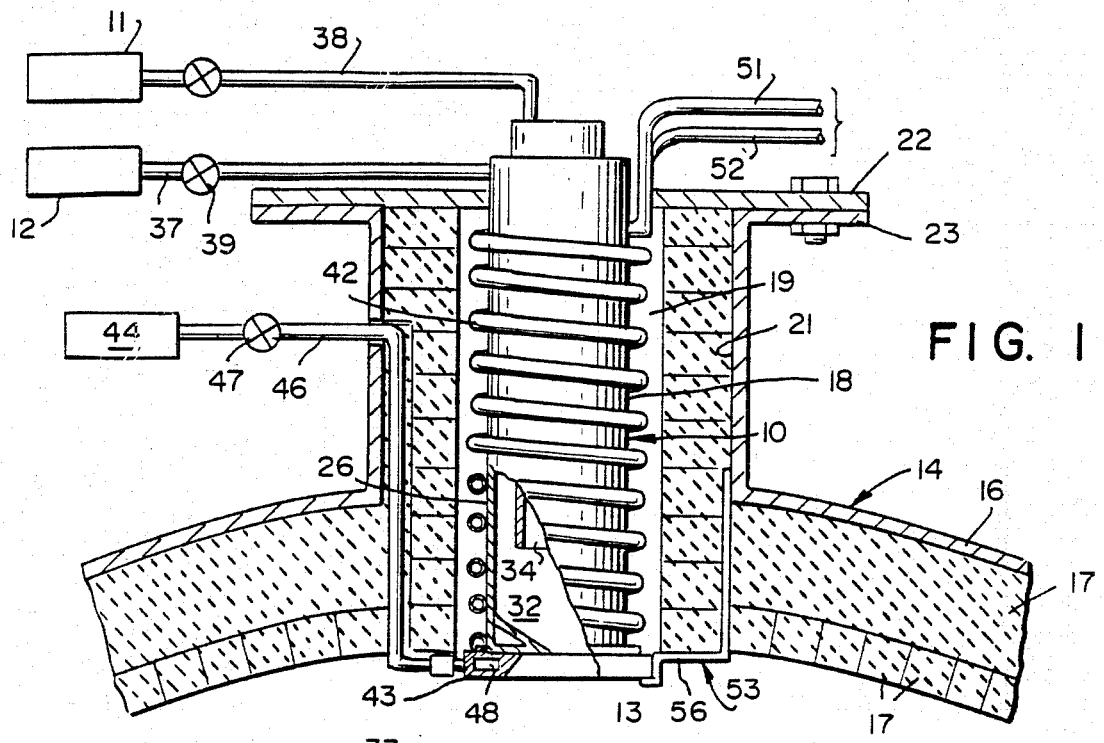
FIG. 1
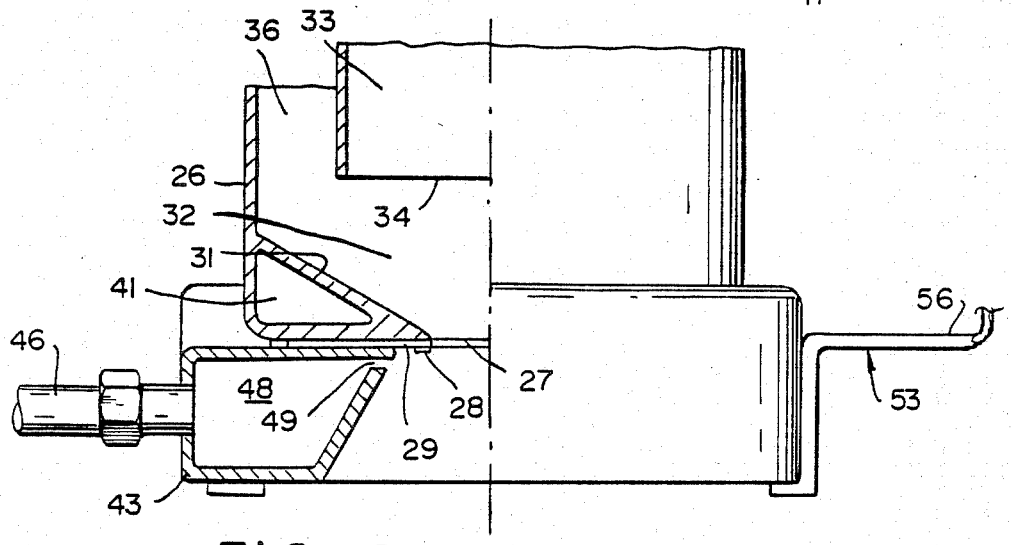
FIG. 2
FIG. 3
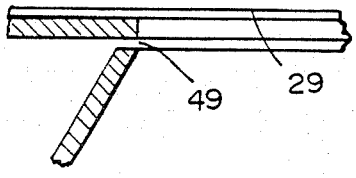

COAL GASIFICATION APPARATUS

BACKGROUND OF THE INVENTION

1. Field of the Invention

This invention relates to an apparatus for generating a synthetic gas by introducing a combustible mixture comprising hydrocarbon fuel, free oxygen-containing gas, and optionally a temperature moderator (liquid or vapor) into a free-flow partial oxidation synthesis gas generator.

2. Description of the Prior Art

In the partial combustion of a hydrocarbon with oxygen, or air enriched with oxygen, in the presence of steam and/or carbon dioxide, temperatures between 1,100° and 1,500° C. are often reached. Special requirements are therefore placed on the design and the material from which the burner is constructed to avoid damage to the latter.

An essential requirement in burner construction of the type contemplated is that they be cooled or otherwise protected from the high temperature environment. This is most often and most readily achieved by circulating water or a similar coolant through the burner unit. Thus, by constructing the burner both internally and externally with coolant passages, a sufficient amount of heat transfer to the circulating cooling fluid can be achieved to minimize and stabilize the temperature which the burner itself reaches.

Normally, the oxidizing flame which combusts the mixture, introduces the hot flame as well as the products of combustion into the reaction chamber of a synthetic gas generator. The latter is lined with a suitable refractory material to avoid damage as a result of the high temperatures that will be reached and sustained.

A relatively vulnerable part of the apparatus however is that section of the burner which is continuously exposed for extended periods of time to the high reactor temperatures. Although means have been provided for cooling internal segments of the burner, the problems which result from the high temperature still persist.

For example, external walls of the burner are generally surrounded with a cooling coil or the like. The latter includes means to circulate a liquid such as water to effectuate a cooling action. Further, the lower or flame end of the burner is provided with passages which permit coolant to be internally circulated to maintain a desired temperature range.

In either instance, the forward most vulnerable face of the burner, can reach certain temperatures, or range of temperatures within which accumulations of particular slag or ash will tend to cling to the exposed burner face. Such a slag build-up will cause a reduction in burner efficiency and eventually impairment of operation and eventual unit shutdown.

These accumulations are prompted generally by back mixing of the combustible particles or ash, as the particles enter the reactor. Here they are caught up into the violently turbulent flows of the gas associated with the high velocity flame.

More specifically it is found that if the temperature on the exposed burner face is in excess of 750° to 900° F., ash particles will be prone to stick thereto. If, on the other hand, the temperature is kept lower than 750° to 900° F. on the face of the burner, the ash sticking possibility will be substantially avoided.

In burners that function as required, it is found that a particle build-up along the burner face will generally commence at the lip of the discharge opening or nozzle. Thereafter, the build-up will progress radially outward from the nozzle and gradually cover a substantial segment of the exposed face. Slag will also build upon itself due to progressive insulation from the cooling coil/-channel.

One way for precluding or at least limiting this slag build-up along the burner face is to inject steam directly into the combustible mixture within the burner itself. This step will facilitate the avoidance of undesired accumulations at the discharge lip. It will not, however, completely preclude the accumulations as herein mentioned.

For example, the back mixing and flow of the particulated matter as a result of the turbulence immediately inside the reactor, will continue to cause or prompt a certain degree of build-up at the burner face.

Toward overcoming the above stated problems, the present invention is addressed to means for providing within the generator reactor chamber a fluid, dynamic shield which protects the entire burner face. The shield takes the configuration of one or more jets of a fluid such as steam, which are projected transversely of the face from a point at the burner periphery.

A number of fluids such as steam, $CO_2$ or even water could serve as the protective dynamic shield. For the present disclosure, however, the fluid will be considered to be steam.

Physically, one or more high velocity steam jets are caused to sweep the burner face. The jets first of all form a barrier which precludes the hot particles from getting to, or contacting the face. Secondly, the fluid jet is so aligned that it will flow parallel to the face, or will impinge against the face preferably adjacent to the discharge lip. This creates a thermal radiation/convection shield to keep the burner face below 750° to 900° F. Thirdly, the flow will clear the face of any accumulation that might be initiated.

It is therefore an object of the invention to provide in combination, a synthetic gas generator and a burner which is adapted for use in combusting a coal-oxygen mixture to achieve a partial oxidation of the gaseous product. A further object is to provide a gas generator adapted to register a burner of the type contemplated, that is capable of withstanding undesired particulate depositions along the burner exposed face. A still further object is to provide a gas generator coolant manifold burner wherein one or more high velocity fluid jets are directed to sweep across the face of a burner to maintain it free of accumulated particulate matter, and to concurrently protect the face by establishing a fluidized radiation/convection shield thereacross.

DESCRIPTION OF THE DRAWINGS

FIG. 1 is a segmentary view in cross-section of a portion of a partial oxidation generator, showing the burner unit.

FIG. 2 is an enlarged segmentary view in partial cross-section of the burner shown in FIG. 1.

FIG. 3 is an alternate embodiment shown in partial cross-section of the burner discharge end.

DESCRIPTION OF THE APPARATUS

One embodiment of a partial oxidation apparatus of the type generally contemplated is shown in FIG. 1 and comprises primarily a burner 10. The latter is normally connected to a source of oxygen 11 as well as to a source 12 of particulated hydrocarbon such as a coal slurry or the like. Thus, the two elements when introduced to the burner, will form a combustible mixture which, as it burns, forms products of combustion. The latter are discharged into the reaction chamber 13 of generator 14.

It will be appreciated that a synthetic gas generator of this type is subjected to sustained high internal temperatures and is formed basically of a steel shell 16. The shell's inner walls and openings therefore, are so constructed and lined with a refractory material 17 that they will withstand the harsh environment.

The discharge end 18 of burner 10 is positioned to introduce the resulting flame, as well as the products of combustion into refractory lined reaction chamber 13. In the latter, the hot products of the partial combustion are collected.

Generator 14 reaction chamber 13 as noted, is provided with a refractory liner as well as with a refractory lined access opening 19, within which burner 10 is registered. Said opening 19 as shown, can include an elongated neck 21 which surrounds the burner to provide a degree of protection thereto.

The upper end of burner 10 is provided with a flange 22 which corresponds with a support flange 23. The latter projects outwardly from reactor neck 21 to hold the burner in place through bolts, and yet permit its ready removal for replacement or repair.

Burner 10 comprises primarily an elongated body 26 having a longitudinal passage which extends the body length. The lower end of said passage terminates at a cylindrical opening 27 which is defined by a peripheral lip 28 at the burner face 29. A progressively narrowing wall 31 connects the body elongated passage with lip 28, to define a mixing compartment 32.

The elongated passage through body 26 is provided with a conduit 33 disposed preferably coaxially thereof. Discharge port 34 terminates at mixing compartment 32 between said conduit 33 and said discharge port.

Proper positioning of conduit 33 defines an elongated annular passage 36 between the conduit walls, and the adjacent walls of the body 26. Annular passage 36 is communicated with source 12 of coal slurry and/or steam, by way of a valved conductor 37 to permit the introduction of the subsequently formed combustible mixture, into the mixing compartment 32.

For the present description, oxygen will be referred to as the combustion supporting medium which is introduced through central conduit 33 by way of valved conduit 38.

In a similar manner, annular passage 36 is communicated with conductor passage 37, which is controlled through valve 39. Said valve is operable to regulate the volume of particulated or finely ground coal mixture which is introduced from source 12 for combining with oxygen, to establish the desired combustible mixture in mixing compartment 32.

Lower face 29 of burner body 26 as herein noted is exposed to the maximum temperature and the turbulent environment experienced within reaction chamber 13. Said lower face 29 is normally formed of a heat resistant material such as inconel or the like which will be capable of functioning in spite of the high temperatures to which it is constantly exposed. However, although capable of withstanding the elevated temperatures, face 29 is nonetheless susceptible to the herein noted particulate accumulations.

To achieve the desired degree of cooling and thermal protection for burner 10, the latter is provided with one or more internal, strategically positioned channels such as 41. The latter are arranged to circulate a coolant, preferably water. The cooling water channels are so arranged within burner body 26 to assure adequate heat removing capability thereby to stabilize the temperature within burner mixing compartment 32, and to protect the entire unit from excessive heating.

Further cooling of the burner is achieved on body 26 by an externally positioned cooling coil 42. The latter is formed as shown of a thermally conductive material to withstand the extreme temperatures, and yet remain capable of conducting a flow of water through conduits 51 and 52 at a sufficient rate to maintain a desired temperature gradient.

To avoid the herein mentioned undesired solid deposit of ash, slag and other particulate matter along burner face 29, an annular manifold 43 is provided. The manifold is disposed within reaction chamber 13 in a manner to cooperate with burner 10, and is communicated with a pressurized source 44 of fluid by way of pipe 46 and control valve 47.

In the embodiment shown, the torus-shaped, annular manifold 43 depends downwardly from generator shell 16 at the lower end of neck 21. Preferably, it extends inwardly to engage the burner face 29.

Manifold 43 comprises in essence a substantially closed annular chamber 48 which is formed of a series of welded plates or communicated compartments. The manifold can engage the lower end of burner 10, or it can be positioned sufficiently close thereto as to permit direction of the fluid flow which is projected transversely of the burner face 29.

As shown in FIG. 2, in one embodiment manifold 43 is provided with a single constricted opening 49 which communicates with fluid chamber 48 to direct a pressurized jet of fluid across the burner face 29. To function most effectively, the fluid, such as steam, preferably traverses burner face 29 in a substantially uninterrupted pattern.

The steam will thus achieve at least two functions. Firstly, it will define a dynamic curtain or barrier across burner face 29. This will substantially preclude slag or ash particles from physically contacting the face. Secondly, the velocity of the steam jet or jets will be such as to dislodge any solid accumulation which might be initiated at lip 28. Thirdly, the disposition of the jet will be such as to afford a thermal radiation shield between face 29 and reaction chamber 13.

The volume of steam which leaves constricted opening 49 will be regulated to avoid adversely affecting production of the partially oxidized product in reaction chamber 13.

Manifold 43 is suspended within the reaction chamber 13 in a manner that it will cooperate with the removable burner 10, and yet itself be removable from generator 14. Thus, manifold 43 is removably fastened to a series of elongated support brackets 53. The latter are fastened to the adjacent walls of neck 21, preferably behind the refractory brick layer which forms the inner wall of the neck. Said brackets 53 are so shaped as to not only position burner 10 but also to maintain contact with the latter in spite of thermal expansion and contraction while operating. The brackets thus embody a transverse segment 56 that will permit burner to expand downwardly against manifold 43 when the burner becomes heated.

The fluid connection 54 which conducts steam into manifold 43 includes at least one member. The latter, to be afforded a degree of protection, can also be disposed behind the refractory brick layer within the neck 21.

Operationally, manifold 43 extends inwardly toward the discharge end of burner 10. To facilitate cooperation with the burner face 29, the manifold upper side can be contoured or shaped that it slidably or abuttingly receives the lower edge of the burner 10. To this end, manifold support members 53 can be conformed with neck 21 in a manner to permit the manifold to be displaced downwardly, and remain in contact with burner 10 when the latter is bolted into place at flange 23.

I claim:

1. The combination with a partial oxidation generator having an insulated wall which defines a reaction chamber to receive products of combustion, and an elongated access port formed in said wall and opening into said reaction chamber to receive a burner, a burner removably registered in said access port including an elongated body having a discharge end forming a combustion chamber, passage means in the body for separately introducing a combustion supporting medium and a particulated hydrocarbon which terminates in the combustion chamber at said burner discharge end, a burner face formed externally of said elongated body at said burner discharge end, and a discharge lip on said face which defines an access port communicated with said combustion chamber to direct products of combustion from the combustion chamber into the generator reaction chamber, a manifold depending from said reactor chamber insulated wall being in contact with but independent of said burner face, said manifold including a torus-like body having a fluid chamber therein forming a circumferential collar about said access port and being spaced outwardly of the discharge lip, means communicating said manifold fluid chamber with a pressurized fluid source, and at least one opening formed in said torus-like body communicated with said fluid chamber, and being directed transversely of the burner face to deliver at least one pressurized stream of said fluid from said manifold toward said burner discharge lip.

2. In the apparatus as defined in claim 1 including at least one valved conduit communicating said manifold fluid chamber with said means forming said pressurized source of fluid.

3. In the apparatus as defined in claim 1, wherein said manifold is disposed transversely of said access port to contact said burner face.

4. In the apparatus as defined in claim 1 including support means depending from said generator wall and extending inwardly thereof to support and position said manifold with respect to said elongated access port.

5. In the apparatus as defined in claim 1, wherein said torous-like body includes a plurality of discharge ports communicated with the fluid chamber being aligned toward said burner lip.

6. In the apparatus as defined in claim 1, wherein the at least one discharge port formed in said manifold comprises a single constricted opening extending circularly about the torous-like body to direct a single substantially continuous stream of fluid toward said lip.

7. In the apparatus as defined in claim 1, wherein said torous-like body is provided with an inner wall that is outwardly divergent away from the burner face.

8. In the apparatus as defined in claim 5, wherein said plurality of ports are equispaced from each other.

9. In the apparatus as defined in claim 1, wherein the torous-like body includes; a central passage formed of outwardly divergent walls, and at least one opening in said body is disposed at the constricted portion formed by said outwardly diverging walls of said central passage.

10. In the apparatus as defined in claim 9, wherein said at least one opening is comprised of a plurality of openings radially spaced and through which said fluid is directed.

* * * * *